US011548062B2

(12) United States Patent
Selepack

(10) Patent No.: US 11,548,062 B2
(45) Date of Patent: Jan. 10, 2023

(54) METHOD FOR REDUCING TARGET SURFACE FEATURES IN CONTINUOUS CASTING

(71) Applicant: Golden Aluminum Company, Fort Lupton, CO (US)

(72) Inventor: Mark Selepack, Longmont, CO (US)

(73) Assignee: Golden Aluminum Company, Fort Lupton, CO (US)

( * ) Notice: Subject to any disclaimer, the term of this patent is extended or adjusted under 35 U.S.C. 154(b) by 0 days.

(21) Appl. No.: 16/238,963

(22) Filed: Jan. 3, 2019

(65) Prior Publication Data

US 2019/0321881 A1 Oct. 24, 2019

Related U.S. Application Data

(63) Continuation of application No. 15/961,611, filed on Apr. 24, 2018, now Pat. No. 11,130,171.

(51) Int. Cl.

| | |
|---|---|
| ***B22D 11/126*** | (2006.01) |
| ***B22D 11/00*** | (2006.01) |
| *B22D 11/06* | (2006.01) |

(52) U.S. Cl.

CPC ..... *B22D 11/126* (2013.01); *B22D 11/003* (2013.01); *B22D 11/0605* (2013.01); *B22D 11/0622* (2013.01)

(58) Field of Classification Search

CPC . B22D 11/126; B22D 11/003; B22D 11/0605; B22D 11/0622

See application file for complete search history.

(56) References Cited

U.S. PATENT DOCUMENTS

| | | | | |
|---|---|---|---|---|
| 4,093,782 | A * | 6/1978 | Anthony | C22C 21/02 428/654 |
| 4,250,726 | A | 2/1981 | Safian et al. | |
| 5,590,703 | A * | 1/1997 | Eckert | B22D 11/12 164/476 |
| 5,803,997 | A * | 9/1998 | Haszler | C22F 1/053 148/691 |
| 6,582,586 | B1 * | 6/2003 | Akashi | C25F 1/06 205/714 |
| 8,122,940 | B2 * | 2/2012 | Romanowski | B22D 11/008 164/461 |

(Continued)

FOREIGN PATENT DOCUMENTS

| | | |
|---|---|---|
| DE | 7111221 | 3/1972 |
| DE | 2418642 | 10/1975 |

(Continued)

OTHER PUBLICATIONS

Guenther et al. (DE2418642A1) English translation by machine (Year: 2020).*

(Continued)

*Primary Examiner* — Robert S Jones, Jr.
*Assistant Examiner* — Jiangtian Xu
(74) *Attorney, Agent, or Firm* — Sheridan Ross P.C.

(57) ABSTRACT

A method for reducing target surface features in continuously cast articles is described. The method can remove a target surface feature, such as a compositional variation or casting defect, from the continuously cast article by removing, before cold rolling, material from the continuously cast article surface.

24 Claims, 7 Drawing Sheets

(56) References Cited

U.S. PATENT DOCUMENTS

| | | | | |
|---|---|---|---|---|
| 10,589,327 | B2 * | 3/2020 | Stewart | B21B 45/0215 |
| 2009/0314457 | A1 | 12/2009 | Seidel et al. | |

FOREIGN PATENT DOCUMENTS

| | | | | |
|---|---|---|---|---|
| DE | 2418642 | A1 * | 11/1975 | B21B 45/08 |
| DE | 2440798 | | 3/1976 | |
| GB | 1337341 | | 11/1973 | |
| JP | S52-144358 | | 12/1977 | |

OTHER PUBLICATIONS

U.S. Appl. No. 15/961,611, filed Apr. 24, 2018, Selepack.
"Aluminum Alloy," Wikipedia, Last Modified Jul. 24, 2018, retrieved at https://en.wikipedia.org/wiki/Aluminium_alloy, 17 pages.
Kopeliovich, "Continuous casting in traveling mold," Substech Substances & Technologies, Last Modified May 31, 2012, retrieved at http://www.substech.com/dokuwiki/doku.php?id=continuous_casting_in_traveling_mold,7 pages.
Sever et al., "Forming of Aluminum Alloy Sheets for Automotive Applications," Ohio State University Center for Precision Forming, May 29, 2012, 20 pages.
International Search Report and Written Opinion for International (PCT) Patent Application No. PCT/US2019/28865, dated Aug. 22, 2019, 12 pages.
Official Action for U.S. Appl. No. 15/961,611, dated Jun. 10, 2020, 20 pages.
Official Action for U.S. Appl. No. 15/961,611, dated Mar. 25, 2021, 9 pages.
International Preliminary Report on Patentability for International (PCT) Patent Application No. PCT/US2019/28865, dated Nov. 5, 2020, 11 pages.
Final Action for U.S. Appl. No. 15/961,611, dated Nov. 13, 2020, 19 pages.
Notice of Allowance for U.S. Appl. No. 15/961,611, dated May 20, 2021, 8 pages.

* cited by examiner

METHOD FOR REDUCING TARGET SURFACE FEATURES IN CONTINUOUS CASTING

CROSS REFERENCE TO RELATED APPLICATION

The present application is a continuation of U.S. patent application Ser. No. 15/961,611, filed Apr. 24, 2018 entitled "METHOD FOR REDUCING TARGET SURFACE FEATURES IN CONTINUOUS CASTING", which is incorporated herein by this reference in its entirety.

FIELD

The disclosure relates generally to casting processes and products and particularly to continuously cast strips.

BACKGROUND

Aluminum is a light weight metal having great strength and controlled energy absorption for its weight. Aluminum alloys are extremely workable, weldable and formable. After being worked and formed, aluminum has class-A surface quality. Moreover, aluminum alloys have a high degree of corrosion resistance. For these reasons, aluminum is an excellent choice for car bodies, in particular for automotive panels, side walls, doors, hoods, trucks, wings, spoilers and fins.

In certain applications, objects fabricated from aluminum sheet require a low incidence of target surface features, such as surface deposits (e.g., an oxide layer formed during casting and cooling), defects (e.g., casting defects), and other surface irregularities. In the automotive industry, for example, objects, such as door panels, hoods, trunk lids, and the like, are formed from aluminum alloys. Superior surface quality is required for aesthetics.

Due to the demanding surface quality requirements, aluminum sheet for such applications is more expensive and can be made by fewer processes with semi-continuous direct-chill (DC) casting processes being typically employed to fabricate cylindrical billets or rectangular ingots/blooms for further processing by extrusion, rolling, and/or forging. With reference to FIG. 10, a typical direct-chill casting process 1000 operates by pouring molten metal 1004 continuously into a water-cooled mold 1008 via a trough and vertical downspout (nozzle). The mold 1008 is generally a short mold (e.g., 7.5-15 cm deep) that has holes at the bottom. Water jets flowing from the holes onto the surface of the emerging ingot provide its direct chilling and solidification. Only an outer layer of metal typically solidifies within the water-cooled mold, forming a solid shell of the ingot containing a pool of liquid metal. After leaving the closed mold, the solid shell is further cooled directly by water in a secondary cooling zone, continuing the solidification of the ingot 1012 until complete. Only about 20% of the heat of the molten metal is removed through the mold wall, with the secondary cooling (Direct Chill) contributing the majority of cooling.

To remove target surface features, a scalper 1016, which is typically a rotating circular saw moving in the direction shown, removes approximately 0.25 inches from each of the upper and lower surfaces of the ingot 1012. The scalped ingot 1020 is subsequently preheated and further processed 1024 by a reversing mill (not shown) and hot and cold mills (not shown) to form the aluminum alloy sheet.

Less expensive continuous casting processes are generally not employed due to an unacceptably high incidence of target surface features formed during casting.

SUMMARY

These and other needs are addressed by the various aspects, embodiments, and configurations of the present disclosure.

The present disclosure can provide a method that includes the steps:

providing a continuously cast article having a first target surface feature on a first surface of the continuously cast article; and before cold rolling, removing material from the first surface of the continuously cast article to provide a treated article.

The present disclosure can provide a method that includes the steps:

continuously casting an alloy to form a strip having a target surface feature on a first surface of the continuously cast strip; and before cold rolling, reducing a thickness of the target surface feature while maintaining a substantially constant width of the continuously cast strip derived therefrom to provide a treated strip.

The present disclosure can provide a method that includes the steps:

providing a continuously cast article having a first target surface feature on a first surface of the continuously cast article; and while the continuously cast article has a temperature of about 70 degrees Fahrenheit or more, removing, by one or more of sawing, chemical etching, plasma etching, laser etching, and abrasion, material from the first surface.

In each of the methods, material removal from the continuously cast article can be done in one or more locations: (a) after continuous casting/solidification and before the first hot rolling stand; (b) in between hot rolling stands; (c) at elevated temperature in-line after hot rolling and before cold rolling; and (d) at lower temperature off-line after hot rolling and before cold rolling. In options (c) and (d), the continuously cast article is in the form of hot band.

The continuously cast article can be a cast strip or sheet and can include primarily aluminum. For example, the cast article can be an aluminum alloy selected from the group consisting of aluminum alloys 1XXX, 2XXX, 3XXX, 4XXX, 5XXX, 6XXX, 7XXX, 8XXX, and 9XXX.

The target surface feature can be a compositional variation or deviation, such as an oxide layer or deposit, or a casting defect, such as a streak, drag mark, or block joint, depending on the continuous casting method employed.

The cast strip can be continuously cast by one or more of a rotary caster, a twin-roll caster, a block caster, a twin-belt caster, and a single roll caster.

The amount of material removed typically depends on the finished gauge alloy sheet requirements. Generally, the removing step will remove at least about 10 microns and no more than about 2,000 microns of material.

After material removal, a dimension (e.g., thickness, length, width, and/or surface area) of the first target surface feature on the first surface of the treated article can be less than a corresponding dimension of the first target surface feature on the first surface of the continuously cast article. The degree of reduction of the dimension generally depends on the amount of material removed from the first surface.

The target surface feature can be substantially or completely removed in the treating or reducing step to provide a first surface having a more uniform surface texture compared to the first surface before material removal.

Material removal can be done in one or multiple locations. Typical locations include from the strip after casting and before hot rolling, from partially hot rolled strip between hot rolling stands, and from the hot band after hot rolling.

The present disclosure can provide a number of advantages depending on the particular configuration. The method of the present disclosure can provide a continuously cast strip with a more uniform surface aesthetics on the treated surface(s) of the treated article or strip compared to the cast strip. It can, relative to the continuously cast strip, provide a treated article or strip having fewer target surface features, which translates into a finished gauge sheet with fewer target surface features. In automotive and lithographic applications, for example, the processed sheet can have acceptable levels of target surface features, providing an aesthetically pleasing surface appearance when painted. In particular, the treated surface can have a low microstructural imperfection visible after anodizing. The process can inexpensively produce finished gauge sheet having target surface feature levels comparable to more expensive direct-chill or ingot casting processes. The process can, in fact, duplicate, in a continuous casting process, the beneficial effects of scalping used in direct chill or ingot casting processes.

These and other advantages will be apparent from the disclosure of the aspects, embodiments, and configurations contained herein.

As used herein, "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C", "A, B, and/or C", and "A, B, or C" means A alone, B alone, C alone, A and B together, A and C together, B and C together, or A, B and C together. When each one of A, B, and C in the above expressions refers to an element, such as X, Y, and Z, or class of elements, such as $X_1$-$X_n$, $Y_1$-$Y_m$, and $Z_1$-$Z_o$, the phrase is intended to refer to a single element selected from X, Y, and Z, a combination of elements selected from the same class (e.g., $X_1$ and $X_2$) as well as a combination of elements selected from two or more classes (e.g., $Y_1$ and $Z_o$).

It is to be noted that the term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

The term "abrasion" means to wear, grind, or rub away material from a surface through physical contact of the surface with another object.

The term "chemically etching" means to wear or remove material from a surface by chemical action.

The term "controlled surface treatment" means to use a media, such as a glass, ceramic, or rare earth-containing beads, ball bearings, or other grinding or abrasive media, laser etching, milling, plasma etching, sawing, or other techniques to change or alter a surface property in a controlled or predetermined manner. Surface composition and/or texture can be changed by the controlled surface treatment. A non-limiting example of a change in the surface composition is a change in an amount and/or extent and/or layer thickness and/or areal extent and/or other dimension associated with a target surface feature, such as the amount and/or thickness of oxide present on the surface.

The term "laser etching" means to wear or remove material from a surface using a laser beam.

The term "means" as used herein shall be given its broadest possible interpretation in accordance with 35 U.S.C., Section 112(f) and/or Section 112, Paragraph 6. Accordingly, a claim incorporating the term "means" shall cover all structures, materials, or acts set forth herein, and all of the equivalents thereof. Further, the structures, materials or acts and the equivalents thereof shall include all those described in the summary of the disclosure, brief description of the drawings, detailed description, abstract, and claims themselves.

The term "milling" means to wear or remove material from a surface by using rotary cutters to remove the material by advancing (or feeding) in a direction at an angle with the axis of rotary cutters.

The term "plasma etching" means to wear or remove material from a surface using a high-speed stream of glow discharge (plasma) of an appropriate gas mixture that is shot (in pulses) at the surface. The plasma source, known as etch species, can be either charged (ions) or neutral (atoms and radicals). During the process, the plasma can generate volatile etch products from the chemical reactions between the elements of the material etched and the reactive species generated by the plasma.

The term "sawing" means to cut or remove material from a surface using a saw, or thin blade of metal or other high strength material with a series of sharp teeth.

Unless otherwise noted, all component or composition levels are in reference to the active portion of that component or composition and are exclusive of impurities, for example, residual solvents or by-products, which may be present in commercially available sources of such components or compositions.

All percentages and ratios are calculated by total composition weight, unless indicated otherwise.

It should be understood that every maximum numerical limitation given throughout this disclosure is deemed to include each and every lower numerical limitation as an alternative, as if such lower numerical limitations were expressly written herein. Every minimum numerical limitation given throughout this disclosure is deemed to include each and every higher numerical limitation as an alternative, as if such higher numerical limitations were expressly written herein. Every numerical range given throughout this disclosure is deemed to include each and every narrower numerical range that falls within such broader numerical range, as if such narrower numerical ranges were all expressly written herein. By way of example, the phrase from about 2 to about 4 includes the whole number and/or integer ranges from about 2 to about 3, from about 3 to about 4 and each possible range based on real (e.g., irrational and/or rational) numbers, such as from about 2.1 to about 4.9, from about 2.1 to about 3.4, and so on.

The preceding is a simplified summary of the disclosure to provide an understanding of some aspects of the disclosure. This summary is neither an extensive nor exhaustive overview of the disclosure and its various aspects, embodiments, and configurations. It is intended neither to identify key or critical elements of the disclosure nor to delineate the scope of the disclosure but to present selected concepts of the disclosure in a simplified form as an introduction to the more detailed description presented below. As will be appreciated, other aspects, embodiments, and configurations of the disclosure are possible utilizing, alone or in combination, one or more of the features set forth above or described in detail below. Also, while the disclosure is presented in terms of exemplary embodiments, it should be appreciated that individual aspects of the disclosure can be separately claimed.

BRIEF DESCRIPTION OF THE DRAWINGS

The accompanying drawings are incorporated into and form a part of the specification to illustrate several examples of the present disclosure. These drawings, together with the description, explain the principles of the disclosure. The drawings simply illustrate preferred and alternative examples of how the disclosure can be made and used and are not to be construed as limiting the disclosure to only the illustrated and described examples. Further features and advantages will become apparent from the following, more detailed, description of the various aspects, embodiments, and configurations of the disclosure, as illustrated by the drawings referenced below.

DESCRIPTION OF DISCLOSURE

This disclosure relates generally to a method for reducing or eliminating target surface features in caster strips. More particularly, the disclosure relates to a method for reducing or eliminating target surface features in caster strips in continuous casting processes. The target surface features can be any surface feature targeted for removal, including the oxide surface layer formed immediately following casting when the cast strip is exposed to the atmosphere and casting defects. The oxide surface layer often includes impurities in the continuously cast molten metal. Caster strip defects can be caused by thermal or stress introduced mold distortion or other manufactured mold imperfections regarding surface levelness. Non-limiting examples of caster strip defects include steps, ramps, bows, buckles, streaks, drag marks, protrusions, channels, valleys, and block joints. Target surface features can cause surface quality issues that render aluminum alloy sheet unacceptable for automotive and other aesthetically demanding applications requiring high surface quality.

As discussed below, the process of the disclosure can provide aluminum alloy sheet meeting the high surface quality requirements of these applications by removing the target surface features before cold rolling. Removal after cold rolling can be difficult as the target surface features can be embedded by cold rolling into the surface. Like direct-chill casting, the target surface features can be removed immediately after casting but, unlike direct-chill casting, the target surface features can also be removed between hot rolling stands or from the hot rolled strip or hot band.

Figure 1:
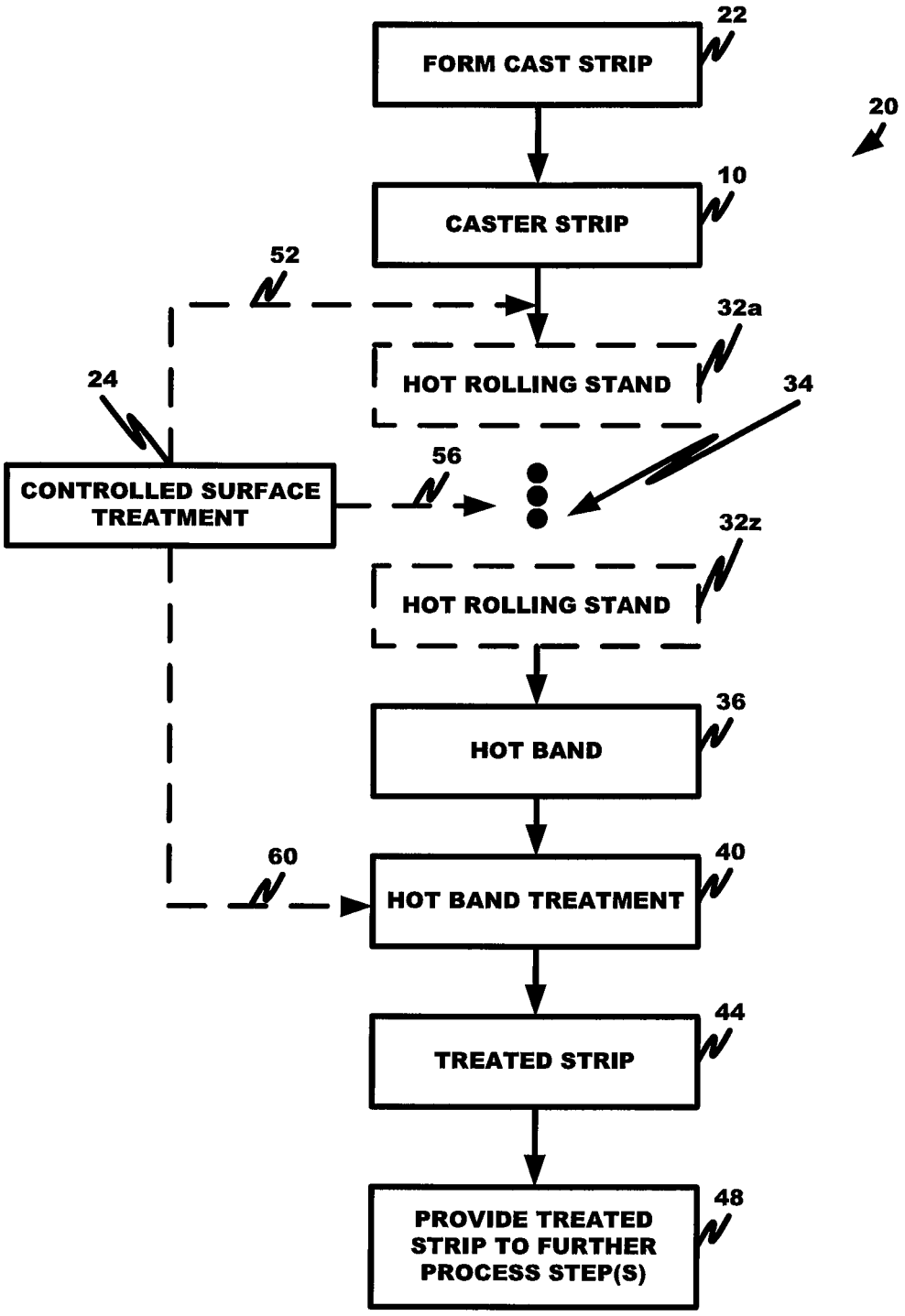
FIG. 1 depicts a process according to an embodiment of this disclosure.
Figure 2:
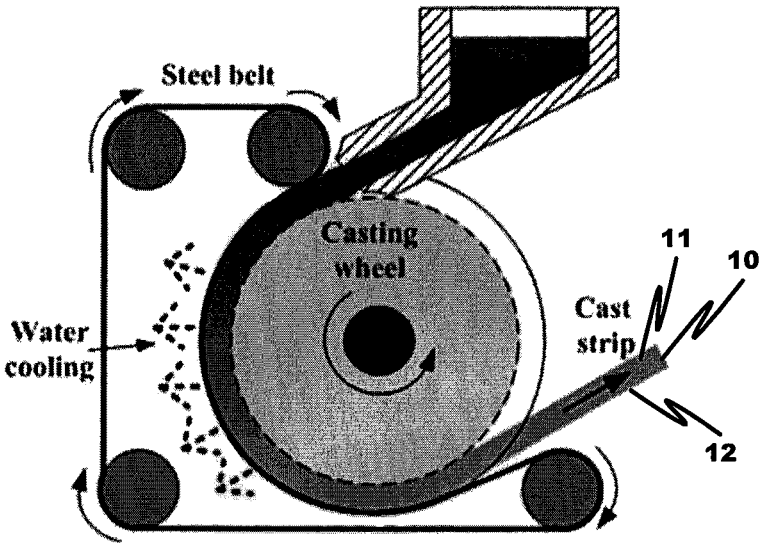
Fig. 2 (Prior Art)
FIG. 2 depicts a prior art rotary caster.
Figure 3:
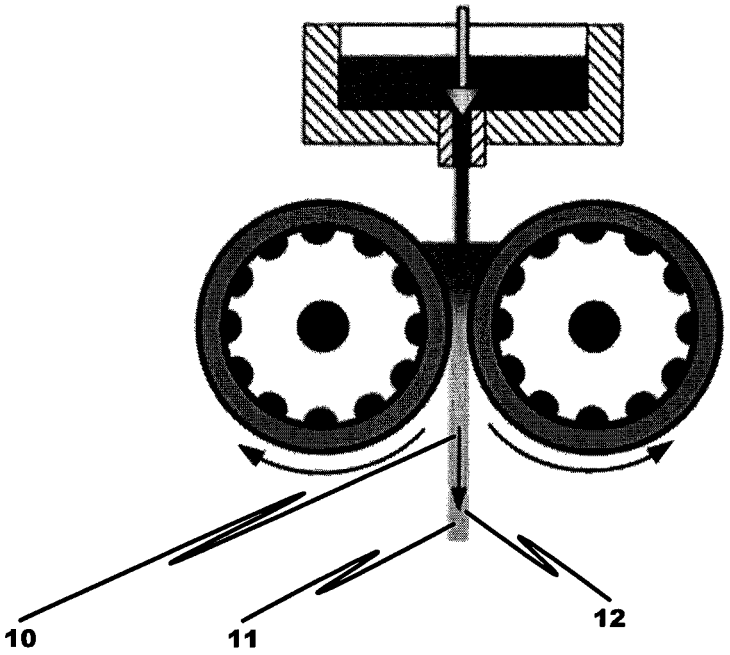
Fig. 3 (Prior Art)
FIG. 3 depicts a prior art vertical downward twin-roll caster.
Figure 4:
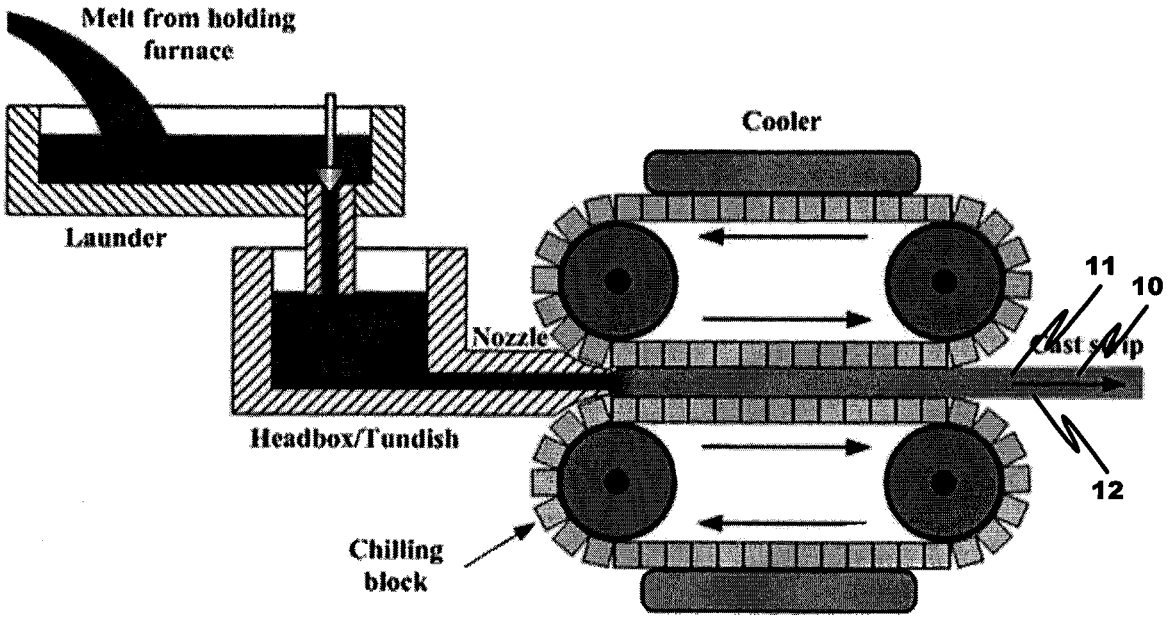
Fig. 4 (Prior Art)
FIG. 4 depicts a prior art block caster.
Figure 5:
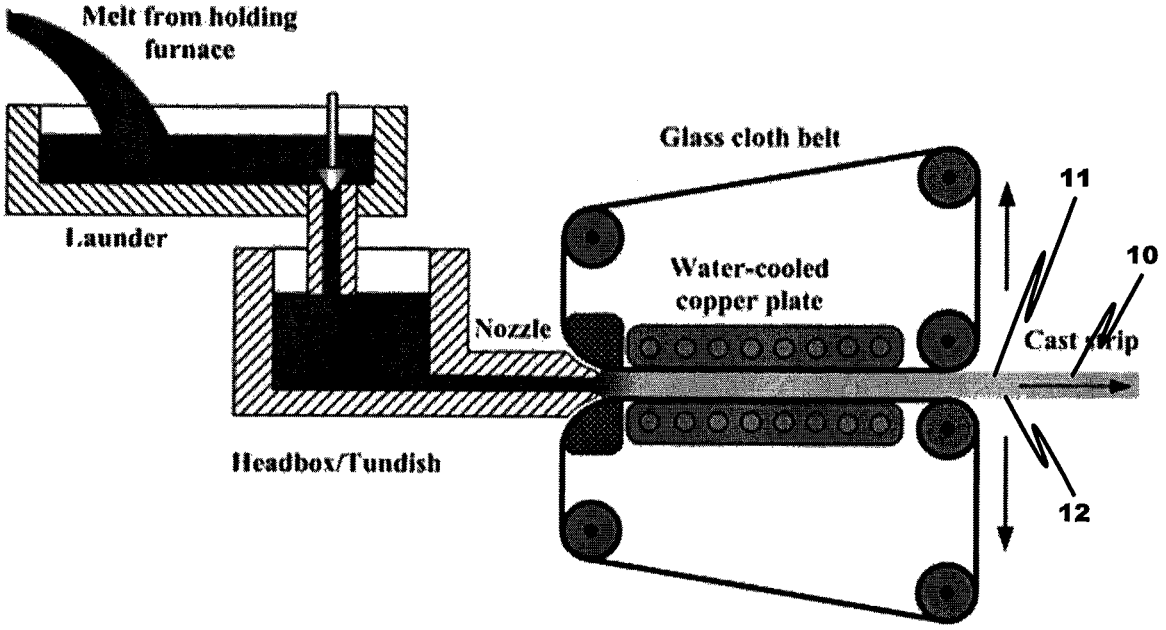
Fig. 5 (Prior Art)
FIG. 5 depicts a prior art twin-belt caster using plate cooling.
Figure 6:
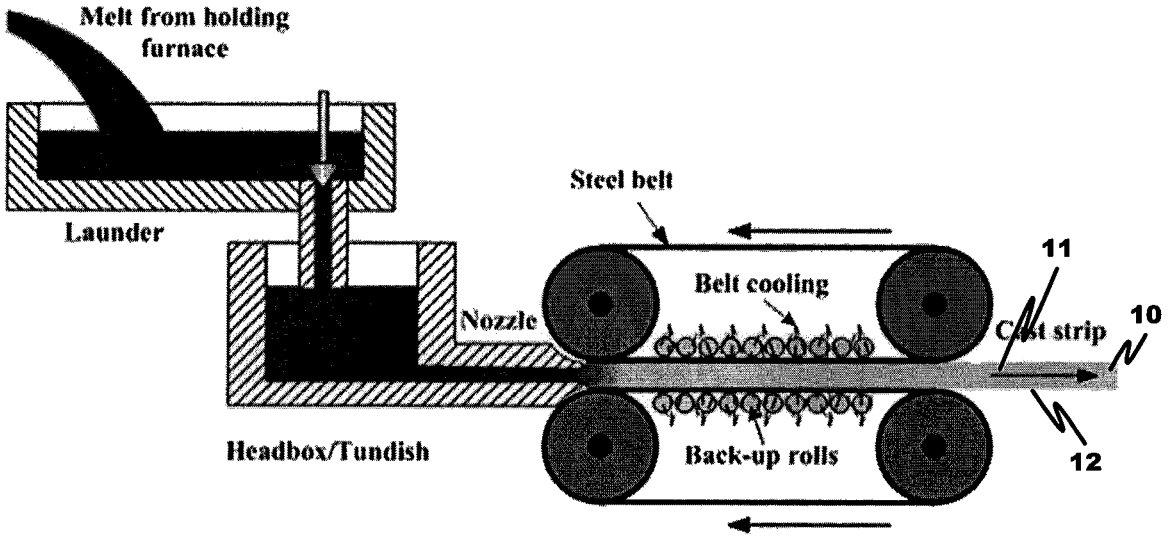
Fig. 6 (Prior Art)
FIG. 6 depicts a prior art twin-belt caster using belt cooling.
Figure 7:
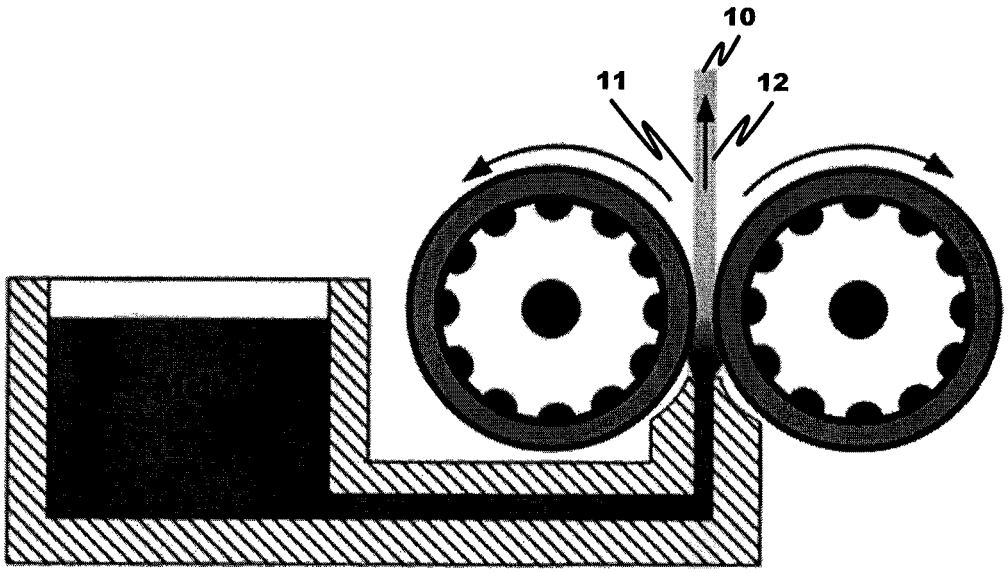
Fig. 7 (Prior Art)
FIG. 7 depicts a prior art vertical upward twin roll caster.
Figure 8:
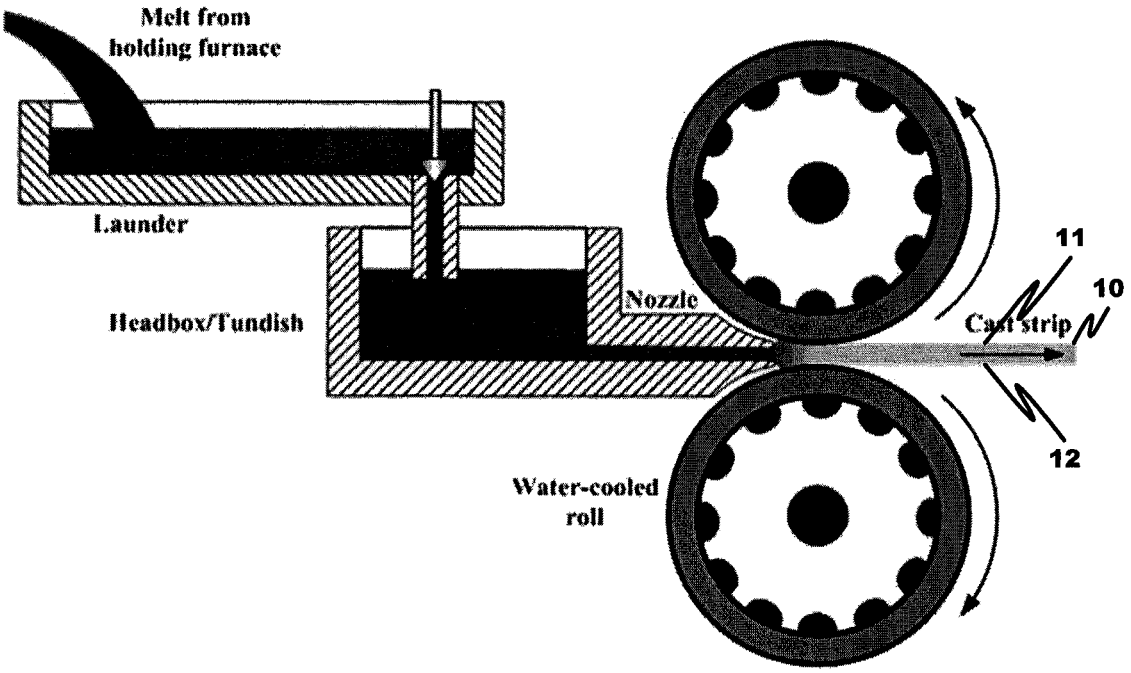
Fig. 8 (Prior Art)
FIG. 8 depicts a prior art horizontal twin-roll caster.
Figure 9:
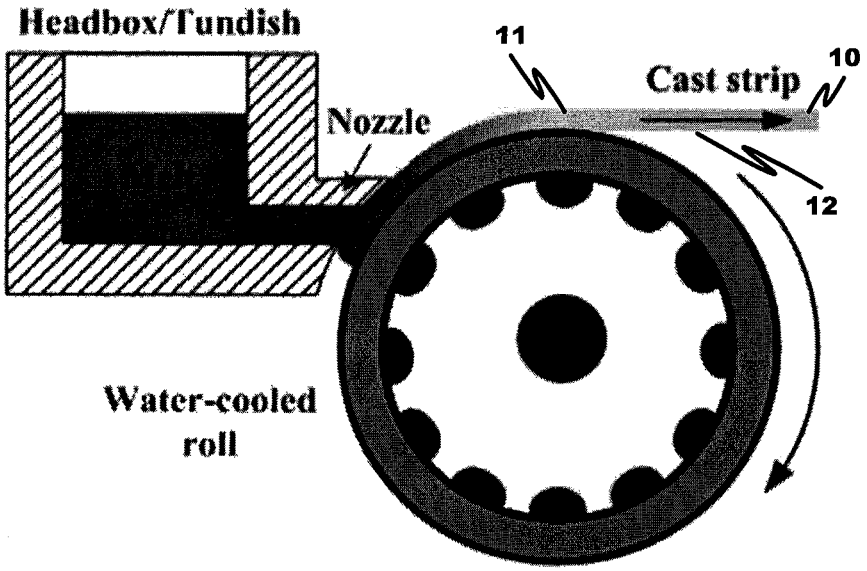
Fig. 9 (Prior Art)
FIG. 9 depicts a prior art single roll caster.
Figure 10:
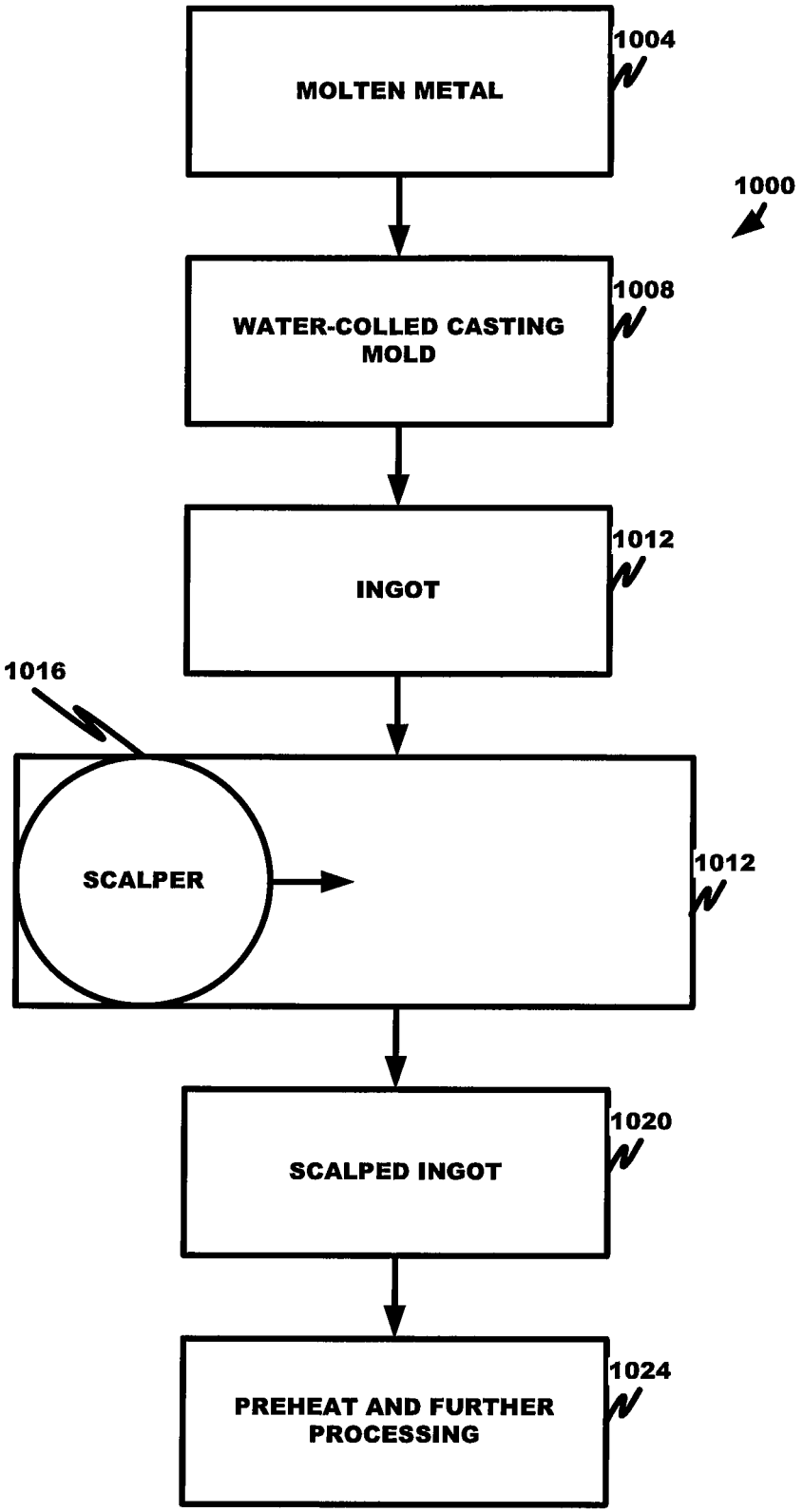
PRIOR ART FIG. 10
FIG. 10 depicts a prior art direct-chill casting process.

FIG. 1 depicts a process 20 for reducing or eliminating target surface features in a caster cast strip. In forming cast strip or casting step 22, a caster strip 10 is formed. The caster strip 10 can be formed by any method. Non-limiting examples of suitable strip casting methods are rotary caster (FIG. 2) (in which a casting wheel rotates as shown conveying melt material from a headbox/tundish into a strip between the steel belt and casting wheel outer surface with thermal transfer to the belt from the melt material being removed by water cooling of the belt), vertical downward twin-roll caster (FIG. 3) (in which opposing rolls rotating in opposing directions downwardly convey melt material from a headbox/tundish into a strip between the rolls with thermal transfer to the rolls from the melt material being removed by water cooling in the interior of each roll), block caster (FIG. 4) (in which opposing endless chilling block-containing belts rotating in opposing directions convey melt material from a launder and headbox/tundish into a strip between the chilling blocks with thermal transfer to the chilling blocks from the melt material being removed by coolers positioned above and below the chilling block-containing belts), twin-belt caster ((FIG. 5) (plate cooling) (in which opposing endless glass cloth belts rotating in opposing directions convey melt material from a launder and headbox/tundish into a strip between the belts with thermal transfer to the belts from the melt material being removed by water-cooled copper plates positioned on opposing sides of each belt from the strip) and (FIG. 6) (belt cooling) (in which opposing endless glass steel belts rotating in opposing directions convey melt material from a launder and headbox/tundish into a strip between the belts with thermal transfer to the belts from the melt material being removed by water cooling of the belt surfaces opposing the belts surfaces in contact with the strip)), vertical upward twin roll caster (FIG. 7) (in which opposing rolls rotating in opposing directions upwardly convey melt material into a strip between the rolls with thermal transfer to the rolls from the melt material being removed by water cooling in the interior of each roll), horizontal twin-roll caster (FIG. 8) (in which opposing rolls rotating in opposing directions horizontally convey melt material from a launder and headbox/tundish into a strip between the rolls with thermal transfer to the rolls from the melt material being removed by water cooling in the interior of each roll), single roll caster (FIG. 9) (in which a rotating roll horizontally conveys melt material from a headbox/tundish into a strip on the top of the roll with thermal transfer to the roll from the melt material being removed by water cooling in the interior of each roll), or any other continuous casting process. It can be appreciated that the casting can be a hot mill caster, cold mill caster, or combination thereof. That is, in a cold mill caster process the respective roll, belt or block is proactively cooled during casting process. This is in contrast to a hot mill caster process where the respective roll, belt or block is passively cooled during the casting process.

The caster strip 10 can comprise any aluminum alloy selected from the group of consisting of aluminum alloys 1XXX, 2XXX, 3XXX, 4XXX, 5XXX, 6XXX, 7XXX, 8XXX, and 9XXX. The caster strip 10 can, for example, be an aluminum alloy suitable for aircraft or aerospace structures, marine structures, or automotive structures. As will be appreciated, the caster strip can be other metals or metal alloys, such as steel.

Each casting method forms a caster strip 10 having target surface features on each of the upper and lower cast strip surfaces 11 and 12 (depending on the casting process employed). As shown in FIGS. 2-9, the upper and lower 11 and 12 cast strip surfaces are in an opposing relationship.

With reference to FIG. 1, a first treatment option to reduce or remove the target surface feature is to reduce or remove the target surface feature by controlled surface treatment 24 after casting and before hot rolling or milling. This treatment option is illustrated by process line 52. In the first treatment option, controlled surface treatment 24 is generally applied to the caster strip 10 while the caster strip 10 has a temperature of from about 700 to about 1,100 degrees Fahrenheit, more generally from about 750 to about 1,100 degrees Fahrenheit, more generally from about 800 to about 1,100 degrees Fahrenheit, more generally from about 850 degrees Fahrenheit to about 1,100 degrees Fahrenheit, and even more generally from about 900 to about 1,100 degrees Fahrenheit.

A second treatment option is to reduce or remove the target surface feature by controlled surface treatment 24 after the caster strip 10 is treated by one or more hot rolling stands 32*a-z*, or is performed at a location 34 between hot rolling stands 32*a-z*. This treatment option is illustrated by process line 56. In the second treatment option, controlled surface treatment is generally applied between hot mill stands to the partially hot rolled strip while the strip has a temperature of from about 500 to about 1,000 degrees Fahrenheit, more generally from about 550 to about 1,000 degrees Fahrenheit, more generally from about 600 to about 1,000 degrees Fahrenheit, more generally from about 700 to about 1,000 degrees Fahrenheit, more generally from about 750 to about 1,000 degrees Fahrenheit, more generally from about 800 degrees Fahrenheit to about 1,000 degrees Fahrenheit, and even more generally from about 850 to about 1,000 degrees Fahrenheit.

A third treatment option is to reduce or remove the target surface feature by controlled surface treatment 24 after processing the caster strip 10 to form hot rolled strip or hot band 36 and before cold rolling of the hot band by one or more cold rolling stands. In other words, controlled surface treatment 24 can be done in-line to the hot band 36 before the first cold rolling stand (not shown). This treatment option is illustrated by process line 60. In the third treatment option, controlled surface treatment 24 is generally applied to the (fully) hot rolled strip 36 while the strip 36 has a temperature of from about 400 to about 850 degrees Fahrenheit, more generally from about 450 to about 850 degrees Fahrenheit, more generally from about 500 degrees Fahrenheit to about 850 degrees Fahrenheit, more generally from about 550 degrees Fahrenheit to about 850 degrees Fahrenheit, more generally from about 600 degrees Fahrenheit to about 850 degrees Fahrenheit, and more generally from about 650 degrees Fahrenheit to about 850 degrees Fahrenheit.

Figure 11:
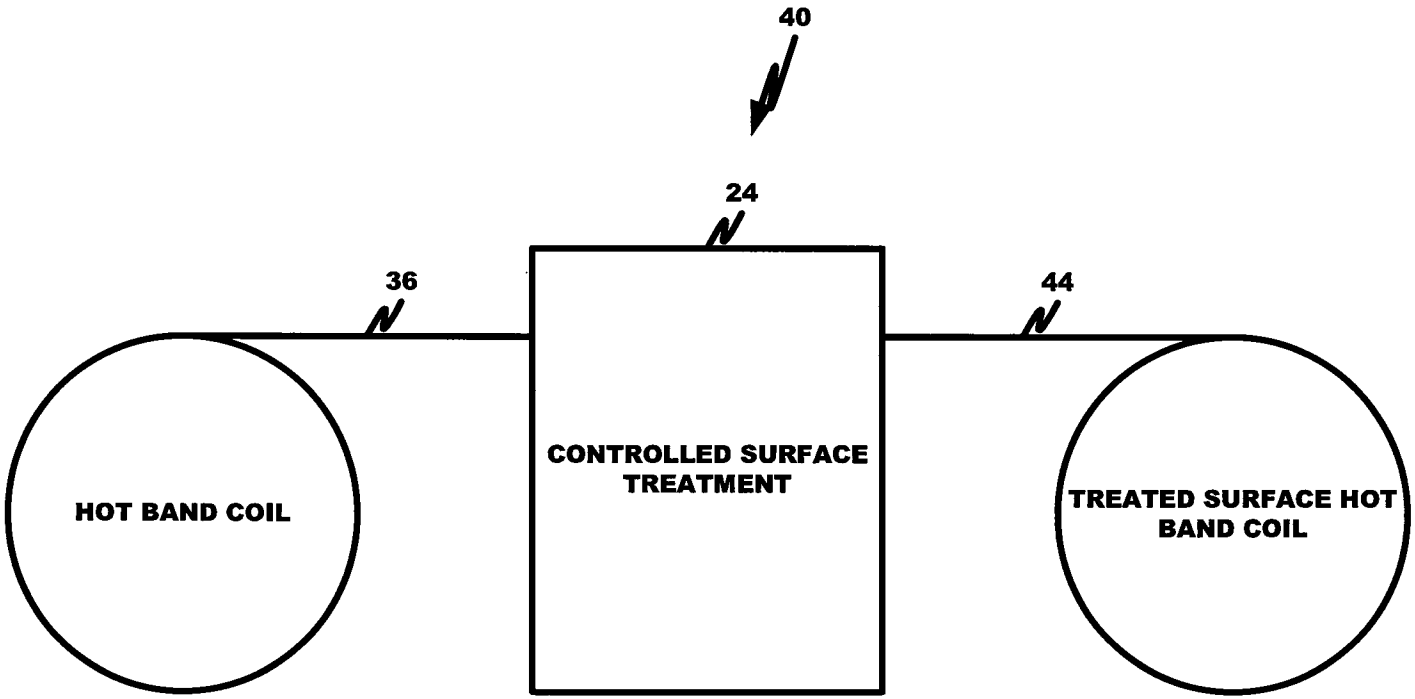
FIG. 11 depicts a hot band treatment process according to an embodiment of the disclosure.

FIG. 11 shows an alternative configuration of the third treatment option. After hot rolling, the hot band strip 36 is coiled, taken off-line, uncoiled and passed through controlled surface treatment 24, and the treated strip 44 rewound to form treated surface hot band (or strip) coil. The treated surface hot band coil can then be put on-line, uncoiled, and subjected to cold rolling and other process steps. Controlled surface treatment 24 is generally applied to the (fully) hot rolled strip 36 while the strip has a temperature of from about 70 degrees Fahrenheit to about 600 degrees Fahrenheit, from about 70 degrees Fahrenheit to about 550 degrees Fahrenheit, from about 70 degrees Fahrenheit to about 500 degrees Fahrenheit, from about 70 degrees Fahrenheit to about 450 degrees Fahrenheit, from about 70 degrees Fahrenheit to about 400 degrees Fahrenheit, more generally from about 100 degrees Fahrenheit to about 350 degrees Fahrenheit, more generally from about 100 degrees Fahrenheit to about 300 degrees Fahrenheit, more generally from about 100 to about 250 degrees Fahrenheit, and even more generally from about 100 to about 200 degrees Fahrenheit.

The above treatment options are not mutually exclusive but can be combined as required by the particular application.

Controlled surface treatment step 24 can include one of more of milling, sawing, chemically treating, plasma treating, laser etching, abrasively treating, or a combination thereof one or more of the opposing strip surfaces. As will be appreciated, certain of the treating techniques, such as laser etching and plasma treating, do not require physical contact with the hot strip surface while other treating techniques, such as milling, sawing, chemically treating, and abrasively treating, require physical contact.

When both of the opposing caster strip surfaces are subjected to controlled surface treatment they can be treated sequentially, in any order, or substantially simultaneously. The controlled surface treatment step 24 is typically performed in line with the casting step 22; that is, treatment is performed as the cast strip moves continuously from the caster and through intervening process steps, such as hot milling, cold milling, and annealing.

Controlled surface treatment 24 can remove, from the treated surface, most or all of the target surface features; that is, controlled surface treatment 24 can reduce the amount of each unit of cast article surface area occupied by one or more target surface features. While the percentage removal of target surface features depends on the finished gauge sheet requirements, controlled surface treatment typically removes at least about 0.5%, more typically at least about 1%, more typically at least about 10%, more typically at least about 25%, more typically at least about 50%, more typically at least about 65%, more typically at least about 75%, and even more typically at least about 96% of the target surface features from each of the untreated surfaces. In some applications, the target surface features are removed from only one of the surfaces. An example would be aluminum alloy sheet to be used for a car door, which requires a high-quality surface only for the door exterior and not for the door interior.

The amount of material required to be removed from each surface in the controlled surface treatment step 24 to remove or eliminate target surface features can vary depending on the finished gauge sheet requirements. Typically, controlled surface treatment removes from each surface at least about 5 microns, more typically at least about 10 microns, more typically at least about 20 microns, more typically at least about 30 microns, more typically at least about 40 microns, and even more typically at least about 50 microns but typically no more than about 2,000 microns, more typically no more than about 1,750 microns, more typically no more than about 1,500 microns, more typically no more than about 1,250 microns, more typically no more than about 1,000 microns, more typically no more than about 750 microns, more typically no more than about 500 microns, more typically no more than about 400 microns, more typically no more than about 300 microns, more typically no more than about 200 microns, more typically no more than about 175 microns, more typically no more than about 150 microns, more typically no more than about 125 microns, and even more typically no more than about 100 microns of material while maintaining a substantially constant width of the cast article. In some applications, the surfaces have different amounts of material removed due to different finished gauge surface requirements.

Commonly, the treating step is done directly after casting of the strip, with no intermediate material removal steps, such as hot milling.

In step 48 of FIG. 1, the treated strip 44 is provided to one or more further process steps 48. The further process steps 48 can be one or more of a cold mill process, intermediate anneal, stabilize anneal, and other process steps that will be appreciated by a skilled artisan.

Controlled surface treatment step 24 can comprise one or more operations. For example, the treatment step 24 can be conducted only one time, such as shown by process lines 52, 56, or 60 or in multiple of the locations shown in FIG. 1.

EXPERIMENTAL

The following examples are provided to illustrate certain aspects, embodiments, and configurations of the disclosure and are not to be construed as limitations on the disclosure, as set forth in the appended claims. All parts and percentages are by weight unless otherwise specified.

A trial was performed using aluminum alloys 5182 (as coil A-17-046) and 6016 (as coils C-15-012 and C-15-015).

All coils were treated by special large brushes to remove the oxide layer (mechanically) and the surface brushed samples were painted, in accordance with an automotive manufacturer's specifications, with gloss black paint and then evaluated against DC standards. The painted coils were determined to meet the MINIMAL acceptance per GM specifications.

A number of variations and modifications of the disclosure can be used. It would be possible to provide for some features of the disclosure without providing others.

For example, in one alternative embodiment, the treating step is performed between hot mill stands, between a hot mill stand and cold mill stand, or between cold mill stands.

The present disclosure, in various aspects, embodiments, and configurations, includes components, methods, processes, systems and/or apparatus substantially as depicted and described herein, including various aspects, embodiments, configurations, subcombinations, and subsets thereof. Those of skill in the art will understand how to make and use the various aspects, aspects, embodiments, and configurations, after understanding the present disclosure. The present disclosure, in various aspects, embodiments, and configurations, includes providing devices and processes in the absence of items not depicted and/or described herein or in various aspects, embodiments, and configurations hereof, including in the absence of such items as may have been used in previous devices or processes, e.g., for improving performance, achieving ease and\or reducing cost of implementation.

The foregoing discussion of the disclosure has been presented for purposes of illustration and description. The foregoing is not intended to limit the disclosure to the form or forms disclosed herein. In the foregoing Detailed Description for example, various features of the disclosure are grouped together in one or more, aspects, embodiments, and configurations for the purpose of streamlining the disclosure. The features of the aspects, embodiments, and configurations of the disclosure may be combined in alternate aspects, embodiments, and configurations other than those discussed above. This method of disclosure is not to be interpreted as reflecting an intention that the disclosure requires more features than are expressly recited in each claim. Rather, as the following claims reflect, inventive aspects lie in less than all features of a single foregoing disclosed aspects, embodiments, and configurations. Thus, the following claims are hereby incorporated into this Detailed Description, with each claim standing on its own as a separate preferred embodiment of the disclosure.

Moreover, though the description of the disclosure has included description of one or more aspects, embodiments, or configurations and certain variations and modifications, other variations, combinations, and modifications are within the scope of the disclosure, e.g., as may be within the skill and knowledge of those in the art, after understanding the present disclosure. It is intended to obtain rights which include alternative aspects, embodiments, and configurations to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A method, comprising:

continuously casting an aluminum alloy to form a continuously cast aluminum alloy article having a first target surface feature on a first surface of the continuously cast aluminum alloy article, wherein the continuously cast aluminum alloy article is a strip or a sheet; and before cold rolling, removing no more than 2,000 μm of material from the first surface of the continuously cast aluminum alloy article to provide a treated article, wherein a dimension of the first target surface feature on the first surface of the treated article is less than a corresponding dimension of the first target surface feature on the first surface of the continuously cast aluminum alloy article, wherein a thickness is reduced by sawing, and wherein the continuously cast aluminum alloy article has a temperature of at least about 400 degrees Fahrenheit during the removing.

2. The method of claim 1, wherein, during the removing of the material from the first surface, the continuously cast aluminum alloy article has a temperature of at least about 700 degrees Fahrenheit, wherein the continuously cast aluminum alloy article comprises primarily aluminum, wherein the continuously cast aluminum alloy article is continuously cast by one or more of a rotary caster, a twin-roll caster, a block caster, a twin-belt caster, and a single roll caster, and wherein the first target surface feature is removed from the first surface in the removing of the material from the first surface.

3. The method of claim 1, wherein the first target surface feature is a compositional deviation, wherein the aluminum alloy of the continuously cast aluminum alloy article is selected from the group consisting of aluminum alloys 1XXX, 2XXX, 3XXX, 4XXX, 5XXX, 6XXX, 7XXX, 8XXX, and 9XXX, wherein, in the removing of the material from the first surface, at least about 10 microns of material is removed from the first surface, and wherein at least 75% of the first target surface feature is removed from the first surface during the removing of the material from the first surface.

4. The method of claim 2, wherein the first target surface feature is one or more of a step, ramp, bow, buckle, streak, drag mark, and block joint, wherein at least 75% of the first target surface feature is removed from the first surface during the removing of the material from the first surface, wherein, in the removing of the material from the first surface, at least about 50 microns of material is removed from the first surface, and wherein the removing of the material from the first surface is performed before hot rolling.

5. The method of claim 1, wherein the first target surface feature comprises an oxidized surface, wherein, during the removing of the material from the first surface, the continuously cast aluminum alloy article has a temperature of at least about 500 degrees Fahrenheit, wherein at least 75% of the first target surface feature is removed from the first surface during the removing of the material from the first surface, and wherein the removing of the material from the first surface is performed between hot rolling stands.

6. The method of claim 1, wherein at least about 50 microns of the material is removed from the first surface, wherein at least 75% of the first target surface feature is removed from the first surface during the removing of the material from the first surface, and wherein the removing of the material from the first surface is performed after hot rolling is completed.

7. The method of claim 6, wherein the aluminum alloy of the continuously cast aluminum alloy article is selected from the group consisting of aluminum alloys 1XXX, 2XXX, 3XXX, 4XXX, 5XXX, 6XXX, 7XXX, 8XXX, and 9XXX, and wherein, during the removing of the material from the first surface, the continuously cast aluminum alloy article has a temperature of at least about 500 degrees Fahrenheit.

8. The method of claim 1, wherein the aluminum alloy of the continuously cast aluminum alloy article is selected from the group consisting of aluminum alloys 1XXX, 2XXX, 3XXX, 4XXX, 5XXX, 6XXX, 7XXX, 8XXX, and 9XXX, and wherein at least about 25% of the first target surface feature is removed during the removing of the material from the first surface.

9. A method, comprising:

continuously casting an aluminum alloy to form a continuously cast strip having a target surface feature on a first surface of the continuously cast strip;

after casting and before hot rolling, reducing a thickness of the target surface feature while maintaining a constant width of the continuously cast strip derived therefrom to provide a treated strip, wherein the target surface feature is removed from the first surface during the reducing of the thickness of the target surface feature, and wherein the thickness is reduced by one or more of chemically etching, plasma etching, and laser etching, wherein the continuously cast strip has a temperature of at least about 500 degrees Fahrenheit during the removing of the target surface feature; and rolling the treated strip, wherein the rolling comprises hot rolling.

10. The method of claim 9, wherein, during the reducing of the thickness of the target surface feature, the continuously cast strip has a temperature of at least about 700 degrees Fahrenheit, wherein the continuously cast strip comprises primarily aluminum, wherein the continuously cast strip is continuously cast by one or more of a rotary caster, a twin-roll caster, a block caster, a twin-belt caster, and a single roll caster, and wherein the target surface feature is removed from the first surface by removing material from the first surface.

11. The method of claim 9, wherein the target surface feature is a compositional variation, wherein the continuously cast strip is an aluminum alloy selected from the group consisting of aluminum alloys 1XXX, 2XXX, 3XXX, 4XXX, 5XXX, 6XXX, 7XXX, 8XXX, and 9XXX, wherein at least about 10 microns of material is removed from the first surface, and wherein at least 75% of the target surface feature is removed from the first surface during the reducing of the thickness of the target surface feature.

12. The method of claim 10, wherein the target surface feature is one or more of a step, ramp, bow, buckle, streak, drag mark, and block joint, wherein at least 75% of the target surface feature is removed from the first surface during the reducing of the thickness of the target surface feature, and wherein, in the reducing of the thickness of the target surface feature, at least about 50 microns of material is removed from the first surface.

13. The method of claim 9, wherein the target surface feature comprises an oxidized surface, wherein, during the reducing of the thickness of the target surface feature, the continuously cast strip has a temperature of at least about 700 degrees Fahrenheit, and wherein at least 75% of the target surface feature is removed from the first surface during the reducing of the thickness of the target surface feature.

14. The method of claim 9, wherein, in the reducing of the thickness of the target surface feature, at least about 50 microns of material is removed from the first surface, and wherein at least 75% of the target surface feature is removed from the first surface during the reducing of the thickness of the target surface feature.

15. The method of claim 14, wherein the aluminum alloy is selected from the group consisting of aluminum alloys 1XXX, 2XXX, 3XXX, 4XXX, 5XXX, 6XXX, 7XXX, 8XXX, and 9XXX, and wherein, during the reducing of the thickness of the target surface feature, the continuously cast strip has a temperature of at least about 700 degrees Fahrenheit.

16. The method of claim 9, wherein the thickness is reduced by chemically etching, wherein the aluminum alloy is selected from the group consisting of aluminum alloys 1XXX, 2XXX, 3XXX, 4XXX, 5XXX, 6XXX, 7XXX, 8XXX, and 9XXX, and wherein at least about 25% of the target surface feature is removed during the reducing of the thickness of the target surface feature.

17. A method, comprising:

continuously casting an aluminum alloy to form a continuously cast aluminum alloy article having a first target surface feature on a first surface of the continuously cast aluminum alloy article, wherein the continuously cast aluminum alloy article is a strip or a sheet;

before cold rolling, removing, by one or more of chemical etching, plasma etching, and laser etching, material from the first surface to form a treated article, wherein the continuously cast aluminum alloy article has a temperature of at least about 400 degrees Fahrenheit during the removing; and rolling the treated article, wherein the rolling comprises cold rolling.

18. The method of claim 17, wherein the first target surface feature is removed from the first surface during the removing of the material, by one or more of chemical etching, plasma etching, and laser etching, of the material from the first surface, wherein, during the removing of the material, by one or more of chemical etching, plasma etching, and laser etching, of the material from the first surface, the continuously cast aluminum alloy article has a temperature of at least about 700 degrees Fahrenheit, wherein the continuously cast aluminum alloy article is the strip, wherein the continuously cast aluminum alloy article comprises primarily aluminum, and wherein the continuously cast aluminum alloy article is continuously cast by one or more of a rotary caster, a twin-roll caster, a block caster, a twin-belt caster, and a single roll caster.

19. The method of claim 17, wherein the first target surface feature is a compositional deviation, wherein the aluminum alloy of the continuously cast aluminum alloy article is selected from the group consisting of aluminum alloys 1XXX, 2XXX, 3XXX, 4XXX, 5XXX, 6XXX, 7XXX, 8XXX, and 9XXX, wherein, in the removing of the material from the first surface, at least about 10 microns of material is removed from the first surface, and wherein at least 75% of the first target surface feature is removed from the first surface during the removing.

20. The method of claim 18, wherein the first target surface feature is one or more of a step, ramp, bow, buckle, streak, drag mark, and block joint, wherein at least 75% of the first target surface feature is removed from the first surface during the removing of the material, by one or more of chemical etching, plasma etching, and laser etching, of the material from the first surface, wherein, in the removing of the material, by one or more of chemical etching, plasma etching, and laser etching, of the material from the first surface, at least about 50 microns of material is removed from the first surface, and wherein the removing is performed before hot rolling.

21. The method of claim 17, wherein, during the removing of the material, by one or more of chemical etching, plasma etching, and laser etching, of the material from the first surface, the continuously cast aluminum alloy article has a temperature of at least about 700 degrees Fahrenheit, wherein at least 75% of the first target surface feature is removed from the first surface during the removing of the material, by one or more of chemical etching, plasma etching, and laser etching, of the material from the first surface, and wherein the removing is performed between hot rolling stands.

22. The method of claim 17, wherein, in the removing of the material, by one or more of chemical etching, plasma etching, and laser etching, of the material from the first surface, at least about 50 microns of material is removed from the first surface, wherein at least 75% of the first target surface feature is removed from the first surface during the removing of the material, by one or more of chemical etching, plasma etching, and laser etching, of the material from the first surface, and wherein the removing is performed after hot rolling is completed.

23. The method of claim 22, wherein the aluminum alloy of the continuously cast aluminum alloy article is selected from the group consisting of aluminum alloys 1XXX, 2XXX, 3XXX, 4XXX, 5XXX, 6XXX, 7XXX, 8XXX, and 9XXX, and wherein, during the removing of the material from the first surface, the continuously cast aluminum alloy article has a temperature of at least about 500 degrees Fahrenheit.

24. The method of claim 17, wherein the removing of the material from the first surface occurs by one or more of plasma etching and laser etching.

* * * * *